US007364260B2

(12) United States Patent
Kojima

(10) Patent No.: US 7,364,260 B2
(45) Date of Patent: Apr. 29, 2008

(54) INKJET PRINTER

(75) Inventor: Hiroyuki Kojima, Chiba (JP)

(73) Assignee: Seiko Precision Inc., Chiba (JP)

( * ) Notice: Subject to any disclaimer, the term of this patent is extended or adjusted under 35 U.S.C. 154(b) by 33 days.

(21) Appl. No.: 10/575,301

(22) PCT Filed: Oct. 15, 2004

(86) PCT No.: PCT/JP2004/015268

§ 371 (c)(1),
(2), (4) Date: Apr. 12, 2006

(87) PCT Pub. No.: WO2005/037559

PCT Pub. Date: Apr. 28, 2005

(65) Prior Publication Data

US 2007/0070116 A1 Mar. 29, 2007

(30) Foreign Application Priority Data

Oct. 16, 2003 (JP) ..... 2003-356125

(51) Int. Cl.
*B41J 2/165* (2006.01)

(52) U.S. Cl. ..... 347/33; 347/32

(58) Field of Classification Search ..... 347/22, 347/29, 33, 32

See application file for complete search history.

(56) References Cited

FOREIGN PATENT DOCUMENTS

| | | | | |
|---|---|---|---|---|
| EP | 0945270 | | 9/1999 | |
| JP | 57061574 | | 4/1982 | |
| JP | 02034348 | | 2/1990 | |
| JP | 3(1991)-215043 | * | 9/1991 | ..... 347/33 |
| JP | 06-023999 | | 2/1994 | |
| JP | 06023999 | | 2/1994 | |
| JP | 2543863 | | 5/1996 | |
| JP | 2001-270136 | * | 10/2001 | |
| JP | 2002-361879 | | 12/2002 | |
| WO | WO-88/08370 | | 11/1988 | |

* cited by examiner

*Primary Examiner*—Shih-Wen Hsieh
(74) *Attorney, Agent, or Firm*—Honigman Miller Schwartz & Cohn LLP

(57) ABSTRACT

Included are a recording medium feeder which feeds a recording medium, a printer which carries out a printing for the fed recording medium by ink discharged from a nozzle surface formed on a print head, and a cleaner (50) which cleans the nozzle surface, wherein the cleaner (50) includes a wiper blade unit (70) which wipes the nozzle surface with a wiper blade (75), and a roller wiper unit (60) which absorbs ink on the nozzle surface by ink absorbers (61*b*, 62*b*). The cleaner (50) enables to clean the nozzle surface sufficiently, whereby a good print quality can be maintained.

13 Claims, 9 Drawing Sheets

INKJET PRINTER

TECHNICAL FIELD

The present invention relates to an inkjet printer which is equipped with a cleaner.

BACKGROUND ART

It has been essential that an inkjet printer should be equipped with a cleaner which cleans the nozzle surface of a print head for maintaining a good print quality. As a conventional cleaner, as described in Registered Utility Model Publication No. 2543863, there has been a cleaner which wipes a nozzle surface by a plurality of wiper blades placed over a belt.

Patent Literature 1: Registered Utility Model Publication No. 2543863

DISCLOSURE OF THE INVENTION

Problem to be Solved by the Invention

In the cleaning by the wiper blades of such cleaner as mentioned above, however, the nozzle surface of a print head having a minute nozzle diameter cannot be sufficiently cleaned, thereby resulting in a deterioration of a print quality.

Means for Solving the Problem

In order to solve the aforementioned problem, an inkjet printer of the present invention comprises a recording medium feeder which feeds a recording medium, a printer which carries out a printing for the fed recording medium by ink discharged from a nozzle surface formed on a print head, and a cleaner which cleans the nozzle surface, wherein the cleaner includes a wiper blade unit which wipes the nozzle surface with a plurality of wiper blades, and a roller wiper unit which absorbs ink on the nozzle surface by roller members with ink absorbers.

It is preferable that the print head should be movable along a carrier guide which elongates linearly, and that the recording medium feeder and the cleaner should be arranged side by side with each other along a movement direction of the print head.

It is desirable that the roller wiper unit should be placed at a side closer to the recording medium feeder than the wiper blade unit It is preferable that the roller wiper unit should include a plurality of roller members, and that the plurality of roller members should be placed in such a manner as to allow outer circumferences thereof to be pressure-contacted with one another.

It is preferable that the roller wiper unit should include a first roller member which is so placed as to be able to contact the nozzle surface, and a second roller member placed at a position contacting the first roller member but not contacting the nozzle surface.

It is desirable that the ink absorbers should contain porous materials.

It is preferable that the ink absorbers included in the first roller member and the second roller member should contain porous materials, and that the porous material contained in the ink absorber of the first roller member should be coarser than the porous material contained in the ink absorber of the second roller member.

It is preferable that the roller member should be formed with a gap on the area of the roller member through which a nozzle passes upon contacting the nozzle surface, and it is preferable that the gap should be formed by dividing the roller member along the axial direction thereof, and placing a spacer between divided roller members. The spacer may be detachably placed on the roller member.

It is preferable that the roller member should be able to be driven as the roller member contacts the nozzle surface which moves.

It is preferable that the ink absorbers should be replaceable.

It is preferable that the wiper blade should be so fixed on an endless belt as to face outward, and formed with a recess portion on the area of the wiper blade through which a nozzle passes upon wiping the nozzle surface.

EFFECT OF THE INVENTION

According to the present invention, there is provided an inkjet printer with a cleaner which can sufficiently clean a nozzle surface having a minute nozzle and maintain a good print quality.

EXPLANATION OF REFERENCE NUMBERS

10 Inkjet Printer
20 Recording medium feeder
30 Printer

31 Print head
34*a* Nozzle surface
50 Cleaner
60 Roller Wiper Unit
61*b* Ink Absorber
62*b* Ink Absorber
70 Wiper Blade Unit
75 Scraper (Wiper Blade)
M Recording medium

BEST MODE FOR CARRYING OUT THE INVENTION

An embodiment according to the present invention will now be explained with reference accompanying drawings.

Figure 1:
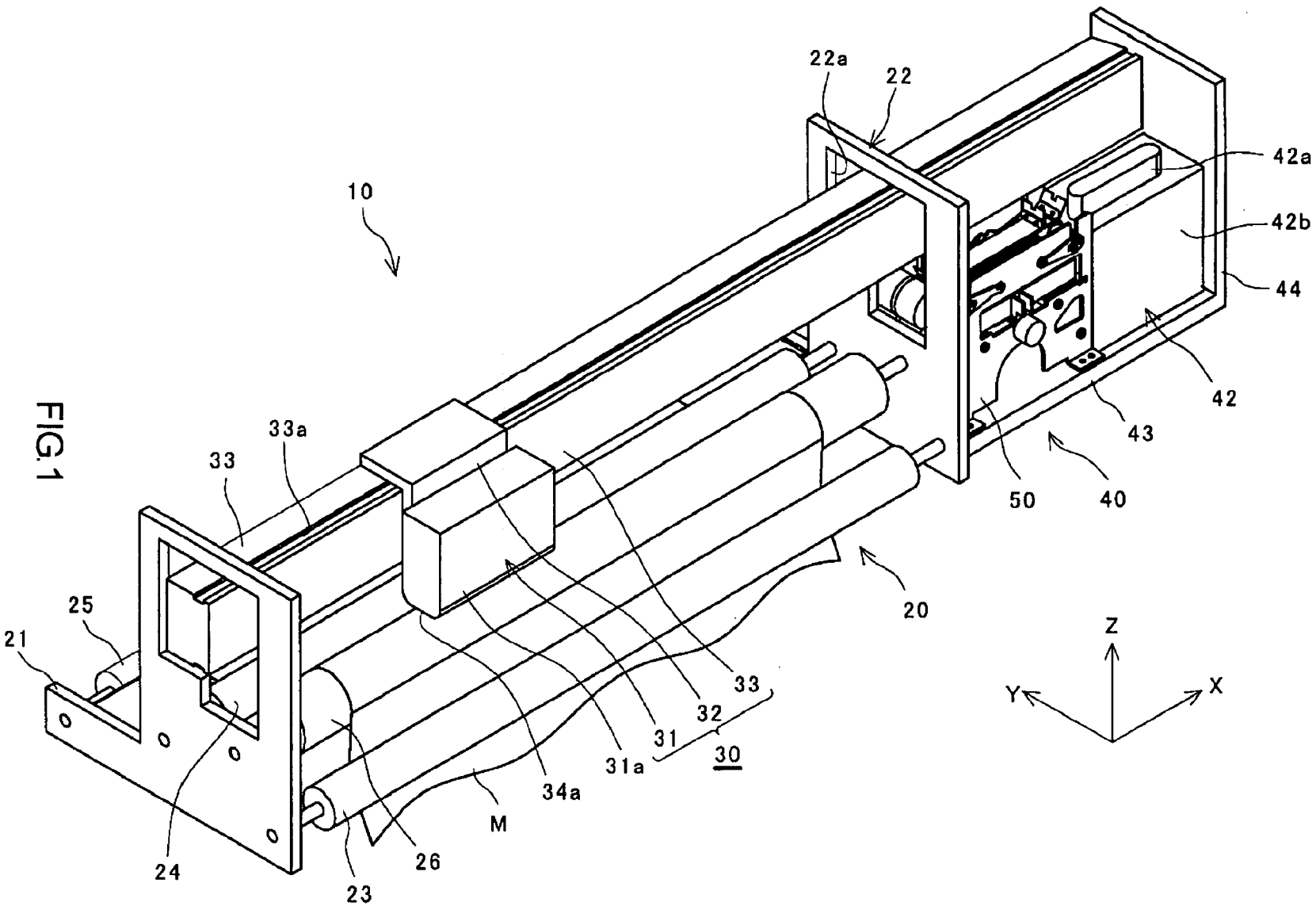
[FIG. 1] It is a perspective view illustrating the structure of an inkjet printer according to an embodiment of the present invention.
Figure 2:
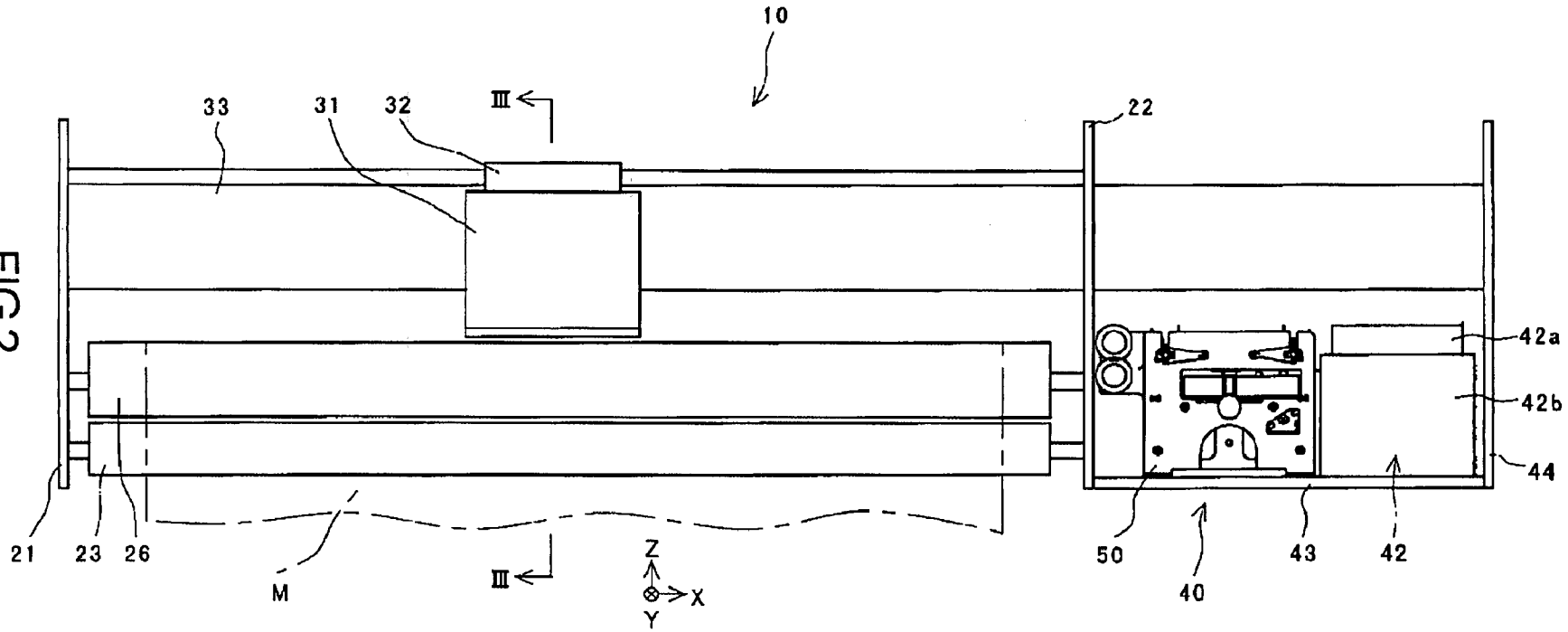
[FIG. 2] It is a side view illustrating the structure of the inkjet printer according to the embodiment of the present invention.
Figure 3:
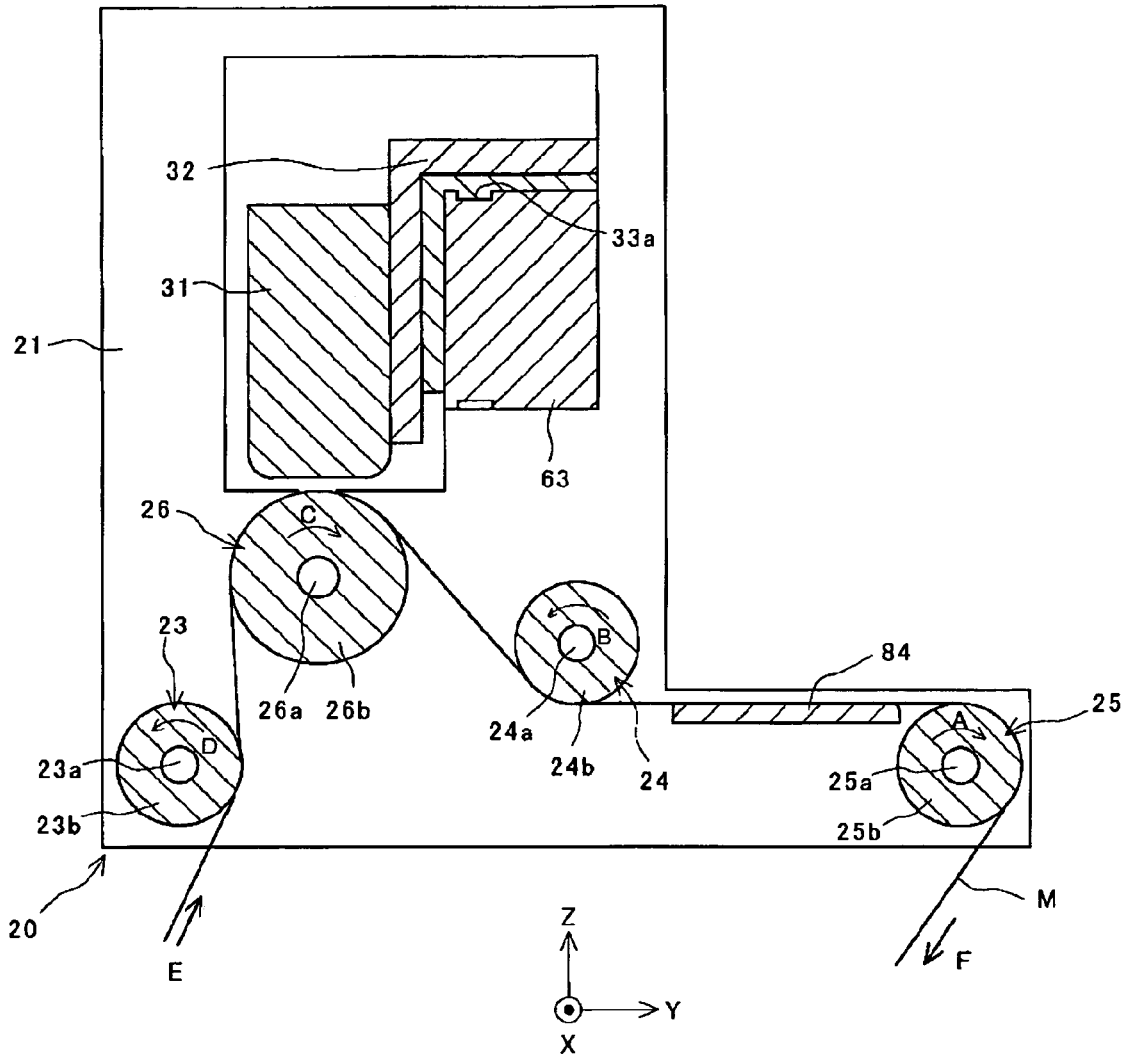
[FIG. 3] It is a partial cross sectional view taken along the line III-III in FIG. 2.

As illustrated in FIGS. 1 to 3, an inkjet printer 10 of the embodiment comprises a recording medium feeder 20, a printer 30, and a maintenance unit 40. In the inkjet printer 10, the printer 30 prints a predetermined character onto a recording medium M supplied from the recording medium feeder 20. The maintenance unit 40 carries out a cleaning for a print head 31, a refilling of ink, etc., when the inkjet printer 10 starts operating, and a user carries out a predetermined control because a print result is poor. At the termination of the inkjet printer 10, a nozzle surface 34*a* is capped by a head maintenance apparatus 42 of the maintenance unit 40 in order to prevent dryness of a nozzle 34*b*, and the contamination of the nozzle surface 34*a*. As the recording medium M, a film base material, a piece of paper, a cloth or the like can be applied to the present invention.

The recording medium feeder 20 includes two sheets of bottom boards 21, 22 which are in parallel with each other, and face each other in the X-direction (print head movement direction) in FIGS. 1 to 3, aluminum-made rollers 23, 24, 25, both ends of shafts 23*a*, 24*a*, 25*a* thereof respectively fixed to bottom boards 21, 22, and a platen 26 in a roller shape, ends of a shaft 26*a* thereof fixed to the respective bottom boards 21, 22, in the same way.

The rollers 23, 24, 25 have cylindrical rotation sections 23*b*, 24*b*, 25*b* slidably and rotatably placed on outer circumferences of the shafts 23*a*, 24*a*, 25*a*, respectively, and the platen 26 has a cylindrical rotation section 26*b* slidably and rotatably placed on an outer circumference of the shaft 26*a*. As illustrated in FIG. 3, the rollers 23, 24, 25, and the platen 26 are arranged in the order of the roller 23, the platen 26, the roller 24, and the roller 25 from their upstream sides in a recording-medium-feed-direction (Y-direction), and in the Z-direction (height direction, up-and-down direction), the roller 23 and the roller 25 are arranged at the same height, the roller 24 is placed on a position higher than the roller 23 and the roller 25, and the platen 26 is placed on a position higher than the roller 24. When the recording medium M is rolled up by the rollers 23, 24, 25, and the platen 26 arranged thus way, and the roller 25 is rotated around the shaft 25*a* in the arrow A direction (FIG. 3) by a predetermined angle, the roller 24, the platen 26 and the roller 23 can be driven to the arrows B, C, and D directions, respectively, and a predetermined tension is applied to the recording medium M along the Y-direction. When the roller 25 is further rotated, the recording medium M moves through directions represented by the arrows E and F, and fed to the Y-direction.

As illustrated in FIGS. 1 to 3, the printer 30 includes the print head 31, a print head carrier 32 which detachably holds the print head 31, and a carrier guide 33. The carrier guide 33 is a member which is formed in an approximately rectangular shape elongating in the X-direction, and both ends thereof are fixed to the bottom board 21 and a support plate 44 by welding, through an aperture 22*a* of the bottom board 22.

Figure 4:
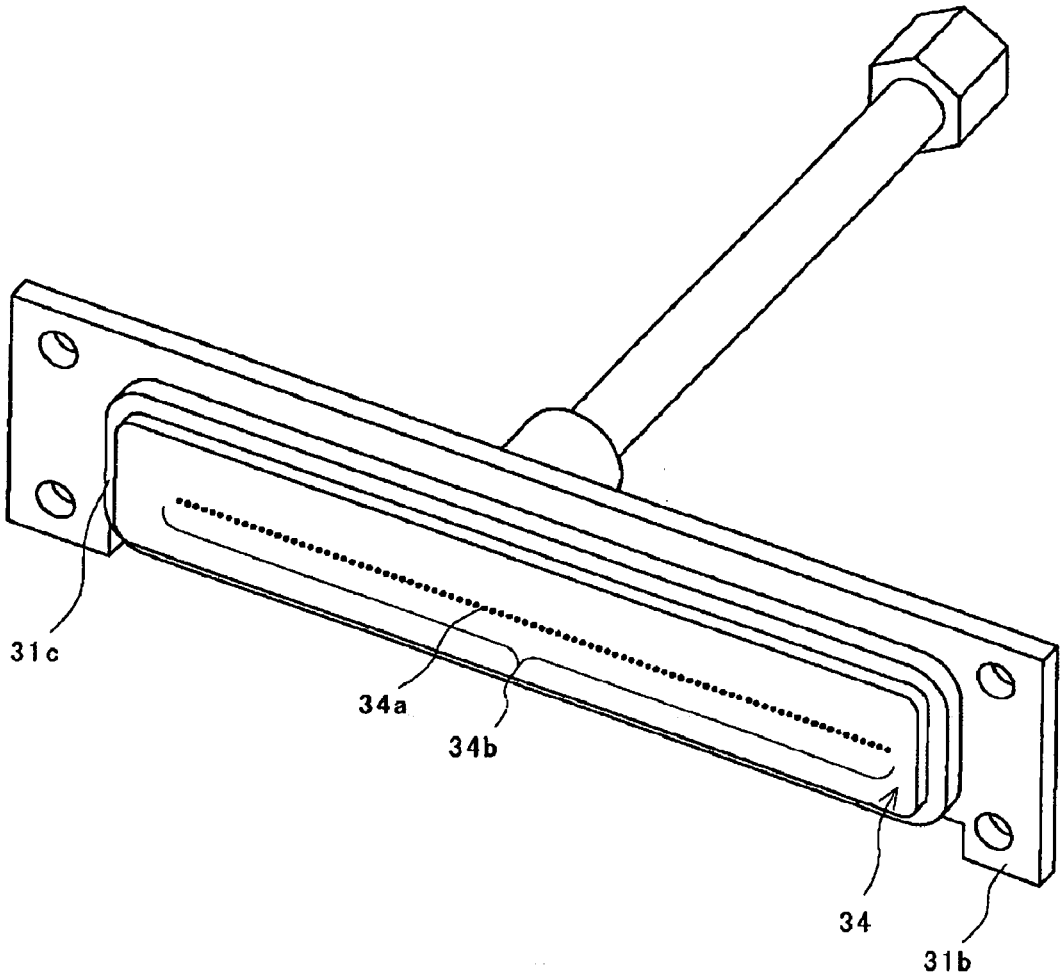
[FIG. 4] It is a perspective view illustrating the inside of a print head and the structure of a nozzle surface, according to the embodiment of the present invention.

As illustrated in FIGS. 1 to 4, the print head 31 is an inkjet print head, wherein a head body 34, an ink channel (not illustrated) and an ink tank (not illustrated) are accommodated in a case 31*a* formed in an approximately rectangular shape. As illustrated in FIG. 4, the nozzle surface 34*a* which is the bottom surface of the head body 34 is fitted into and engaged with an opening 31*c* formed in the center of a bottom surface 31*b* of the approximately rectangular case 31*a*, and the nozzle surface 34*a* downward protrudes from the bottom surface 31*b*. The nozzle surface 34*a*, formed in an approximately rectangular shape and water-repellent-finished, is formed with a plurality of nozzles 34*b* for ink injection in a line along the longitudinal direction of the nozzle surface 34*a* at predetermined intervals.

The print head 31 detachably attached to the print head carrier 32 in such a manner as to allow the nozzle surface 34*a* to face downward, and the print head carrier 32 is movable along a guide rail 33*a* which is formed on the upper surface of the carrier guide 33.

Below the nozzle surface 34*a* of the print head 31, attached to the print head carrier 32, the platen 26 is placed along the movement direction (X-direction) of the print head 31. When ink is downward injected from the predetermined nozzles 34*b* of the nozzle surface 34*a* by a driving apparatus (not illustrated), a predetermined print is carried out onto the recording medium M sliding the upward of the cylindrical rotation section 26*b*. The print head 31 of the embodiment is a print head which carries out a printing at a predetermined position of the carrier guide 33 when placed at the predetermined position, but the present invention is applicable to one type of an inkjet printer that the print head 31 carries out a printing while moving in the X-direction.

As illustrated in FIGS. 1 and 2, the maintenance unit 40 includes a head maintenance apparatus 42 and a cleaner 50. The head maintenance apparatus 42 and the cleaner 50 are aligned each other along the X-direction, and fixed to a base plate 43 which has one end face vertically fixed to a lateral surface of the bottom board 22, and elongates in the X-direction, and the support plate 44 is fixed to the other end face of the base plate 43 in such a manner as to be parallel to the bottom boards 21, 22.

The head maintenance apparatus 42 includes a suction opening 42*a*, made of hollow rubber with its upper portion opened, in the upper surface thereof. The inside of the suction opening 42*a* is vacuumed by a pump (not illustrated) provided in a main body unit 42*b* of the head maintenance apparatus 42, thereby negatively pressurized. By pressing the suction opening 42*a* against the nozzle surface 34*a*, it is possible to vacuum and remove a contaminant and vacuum excessive ink, on the nozzle surface 34*a*.

The cleaner 50 will now be explained with reference to FIGS. 5 to 11. The cleaner 50 includes a main body unit 51, a roller wiper unit (ink absorbing unit) 60, and a wiper blade unit 70. The cleaner 50 arranges the roller wiper unit 70 and the wiper unit 60, in sequential order from the recording medium feeder 20 side, at a halfway position in which the print head 31, positioned upward of the recording medium feeder 20, is moving toward the head maintenance apparatus 42, and excessive ink on the nozzle surface 34*a* can be absorbed and wiped by just passing the print head 31 through the shove of cleaner 50.

Figure 5:
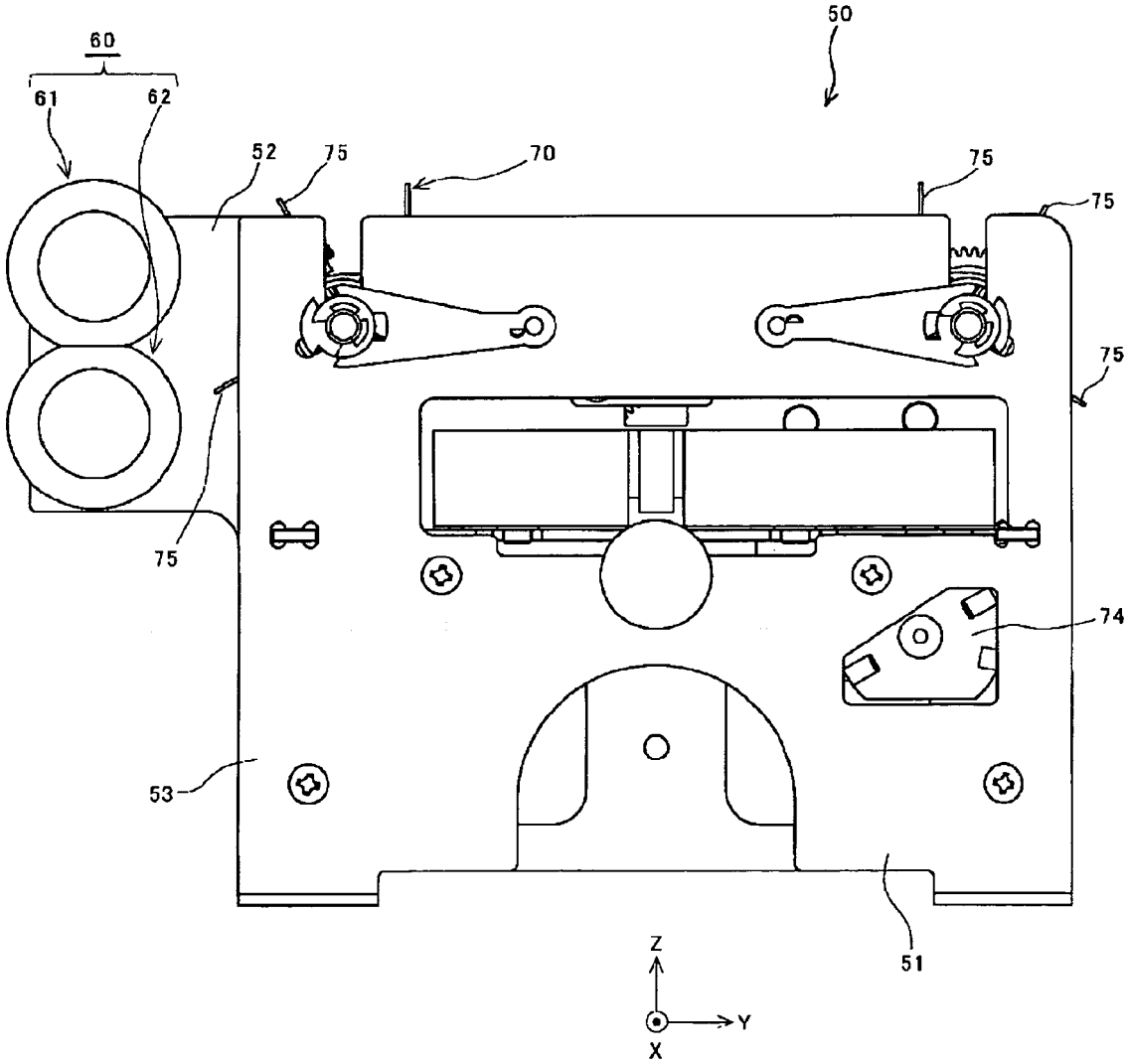
[FIG. 5] It is a side view illustrating the structure of a cleaner according to the embodiment of the present invention.
Figure 6:
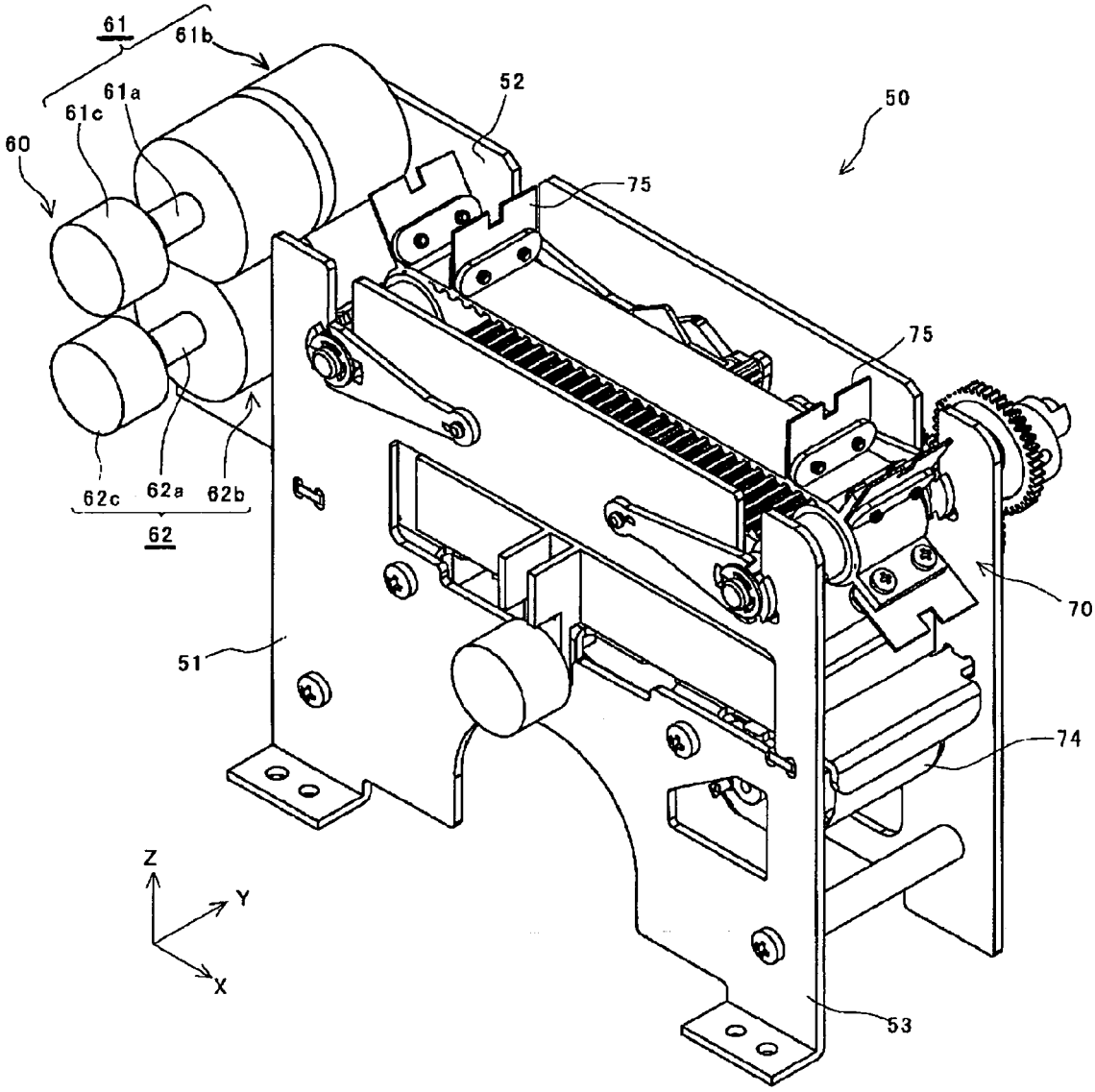
[FIG. 6] It is a perspective view illustrating the structure of the cleaner according to the embodiment of the present invention.
Figure 7A:
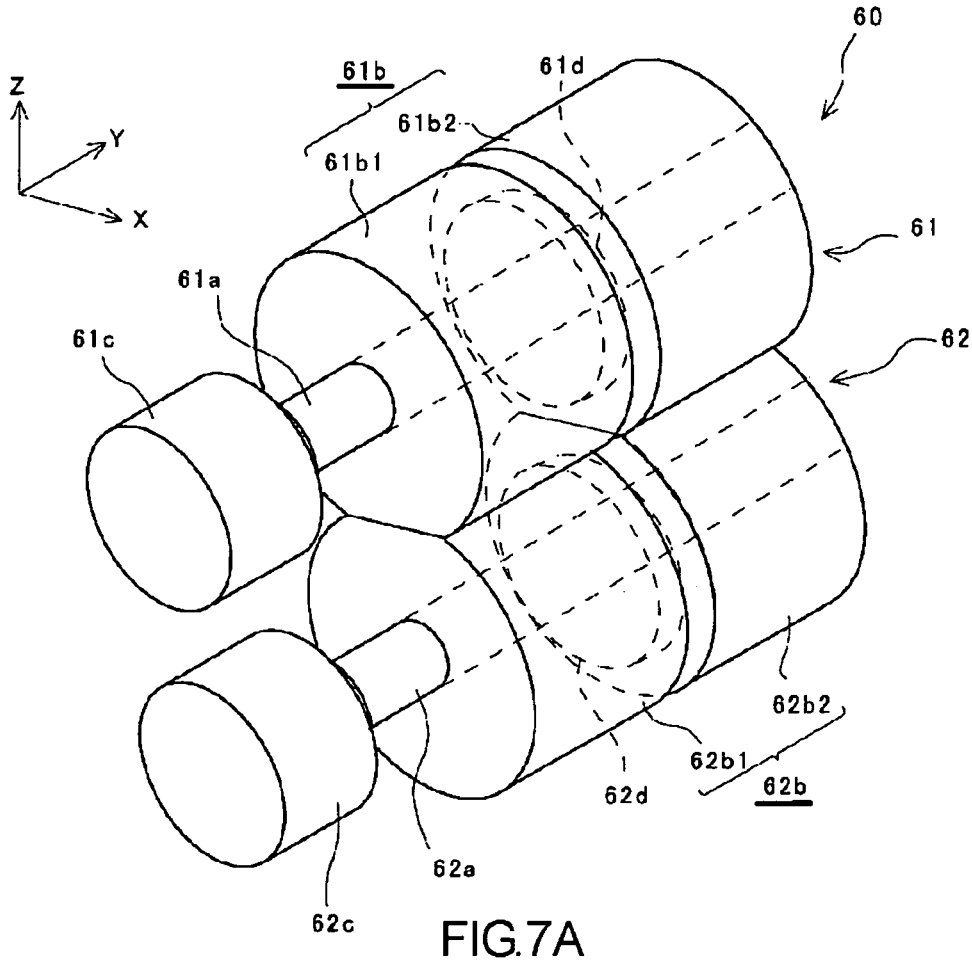
[FIG. 7] It is a d illustrating the structure of a roller wiper unit according to the embodiment of the present invention, (a) is a perspective view, and (b) is a side view.
Figure 7B:
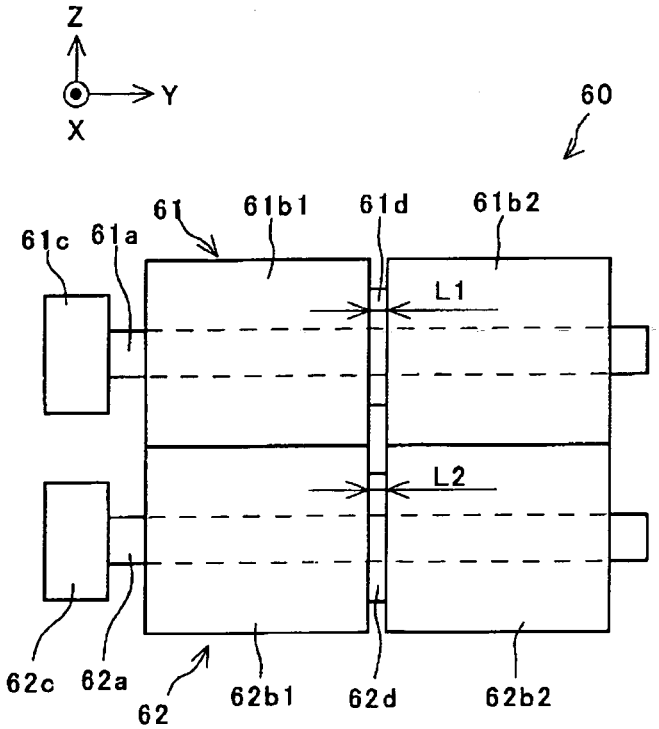

As illustrated in FIGS. 5 to 7, the roller wiper unit 60 comprises the same shaped two of roller member 61 (first roller member) and roller member 62 (second roller member) with shafts 61*a*, 62*a* thereof arranged in the Z-direction. The shafts 61*a*, 62*a* formed by molding plastic material. The roller members 61, 62 respectively have urethane-made cylindrical ink absorbers 61*b*, 62*b* which are rotatable while sliding around the shafts 61*a*, 62*a*. One ends of the shafts 61*a*, 62*a* are fixed to a backing plate 52 of the main body unit 51, and the other ends thereof are fixed to cylindrical members 61*c*, 62*c*, and the ink absorbers 61*b*, 62*b* are retained by the cylindrical members 61*c*, 62*c*, respectively. The arrangement interval of the shaft 61*a* and the shaft 62*a* is set as to be smaller than the sum of the radius of the ink absorber 61*b* and that of the ink absorber 62*b*. Accordingly, the ink absorber 61*b* and the ink absorber 62*b* are pressure-contacted with each other, and contacted in deformed conditions by their elasticity. Meanwhile, the roller members 61, 62 may not be formed in the same shape, and for instance, when the roller member 62, having a larger external diameter than the roller member 61, is adopted, much ink can be held in the roller member 62. The shaft 61*a* and the shaft 62*a* may not be arranged in the Z-direction as long as the roller members 61, 62 contact each other and the shaft 61*a* is placed at a higher position than the shaft 62*a* in the Z-direction. The number of roller members to be placed may be more than or equal to three. The ink absorbers 61*b*, 62*b* may be made of material other than urethane, as long as it is porous material. The ink absorbers 61*b*, 62*b* may be structured such that predetermined areas, from their outer circumferences in their radial directions, are made of porous material, and the other portions are made of material other than porous material.

Both ink absorber 61*b* and ink absorber 62*b* are respectively separated into a first ink absorber 61*b*1, second ink absorber 61*b*2 and first ink absorber 62*b*1, second ink absorber 62*b*2, at the centers of their axial directions. Plastic-made circular spacers 61*d*, 62*d* are placed between the first ink absorber 61*b*1 and the second ink absorber 61*b*2, and the first ink absorber 62*b*1 and the second ink absorber 62*b*2, respectively. The spacers 61*d*, 62*d* are formed by molding plastic material. The spacers 61*d*, 62*d* are formed in the same external shape, and concentrically fixed to the shafts 61*a*, 62*a*, respectively, in bonded manners. The movements of the second ink absorbers 61*b*2, 62*b*2 toward the directions of shafts 61*a*, 62*a* are limited by the spacers 61*d*, 62*d*, and a gap of minimum clearance L1 is formed between the first ink absorber 61*b*1 and the second ink absorber 61*b*2, and a gap of minimum clearance L2 (L1=L2) is formed between the first ink absorber 62*b*1 and the second ink absorber 62*b*2. When the cylindrical members 61*c*, 62*c* are so arranged as to contact the first ink absorber 61*b*1 and the first ink absorber 62*b*1, respectively, the movements of the first ink absorber 61*b*1 and the first ink absorber 62*b*1 toward the shafts 61*a*, 62*a* are limited. Accordingly, the clearances between the first ink absorber 61*b*1 and the second ink absorber 61*b*2, and between the first ink absorber 62*b*1 and the second ink absorber 62*b*2 can be held in constant values (L1, L2). Meanwhile, the spacers 61*d*, 62*d* may be an integral member of the respective shafts 61*a*, 62*a* formed by molding.

In a halfway in which the print head 31 moves to the head maintenance apparatus 42 along the carrier guide 33 for maintenance, and moves to the above of the recording medium feeder 20 after the maintenance for printing, the nozzle surface 34*a* moves toward a predetermined direction while pressure-contacting the ink absorber 61*b*. The ink absorber 61*b*, pressure-contacted by the moving nozzle surface 34*a*, is driven and rotated, and in accordance with this, the ink absorber 62*b* is driven and rotated. The spacer 61*d* is so arranged as to be placed at a path through which the nozzle 34*b* passes when the nozzle surface 34*a* and the ink absorber 61*b* are pressure-contacted (refer to FIG. 11). L1 is set as larger than the nozzle 34*b* by a predetermined magnitude. Accordingly, when the nozzle surface 34*a* moves while pressure-contacting the ink absorber 61*b*, the ink absorber 61*b* does not contact the lined nozzles 34*b* and an area with a predetermined width from that line. Therefore, it is possible to prevent that a contaminant is mixed into the nozzle 34*b* and the nozzle 34*b* is scratched, by preventing the ink absorber 61*b* from no directly pressure-contacting the nozzle 34*b*, and excessive ink on a portion, away from the nozzle 34*b*, of the nozzle surface 34*a* can be absorbed. As the ink absorber 61*b* is formed in a rotatable roller shape, a portion of the ink absorber 61*b*, which is to contact the nozzle surface 34*a* in turn, is a different portion from a portion used for the previous absorbing of ink and thus it is possible to absorb ink smoothly. Likewise, as the ink absorber 62*b* is formed in a rotatable roller shape, a portion of the ink absorber 62*b*, which is to contact the ink absorber 61*b* in turn after the absorbing of ink is a different portion from a portion used for the previous absorbing of ink, and thus it is possible to absorb and hold ink smoothly.

The ink absorber 61*b* and the ink absorber 62*b* are made of porous urethane material, but sizes of pores of the ink absorber 61*b* are larger than those of the ink absorber 62*b*. That is, the ink absorber 61*b* has more rough porosity than the ink absorber 62*b*. Accordingly, the ink absorber 61*b* having larger pores is likely to absorb excessive ink from the nozzle surface 34*a*, the ink absorbed by the ink absorber 61*b* is transferred to the ink absorber 62*b*, and the ink absorber 62*b* is likely to hold ink as their pores are small. The ink absorbers 61*b*, 62*b* can be replaced by, for instance, removing the cylindrical members 61*c*, 62*c* and pulling out from the shafts 61*a*, 62*a*, after absorbing a predetermined amount. Of course, it is possible to replace either one of the ink absorbers 61*b*, 62*b*.

Figure 8:
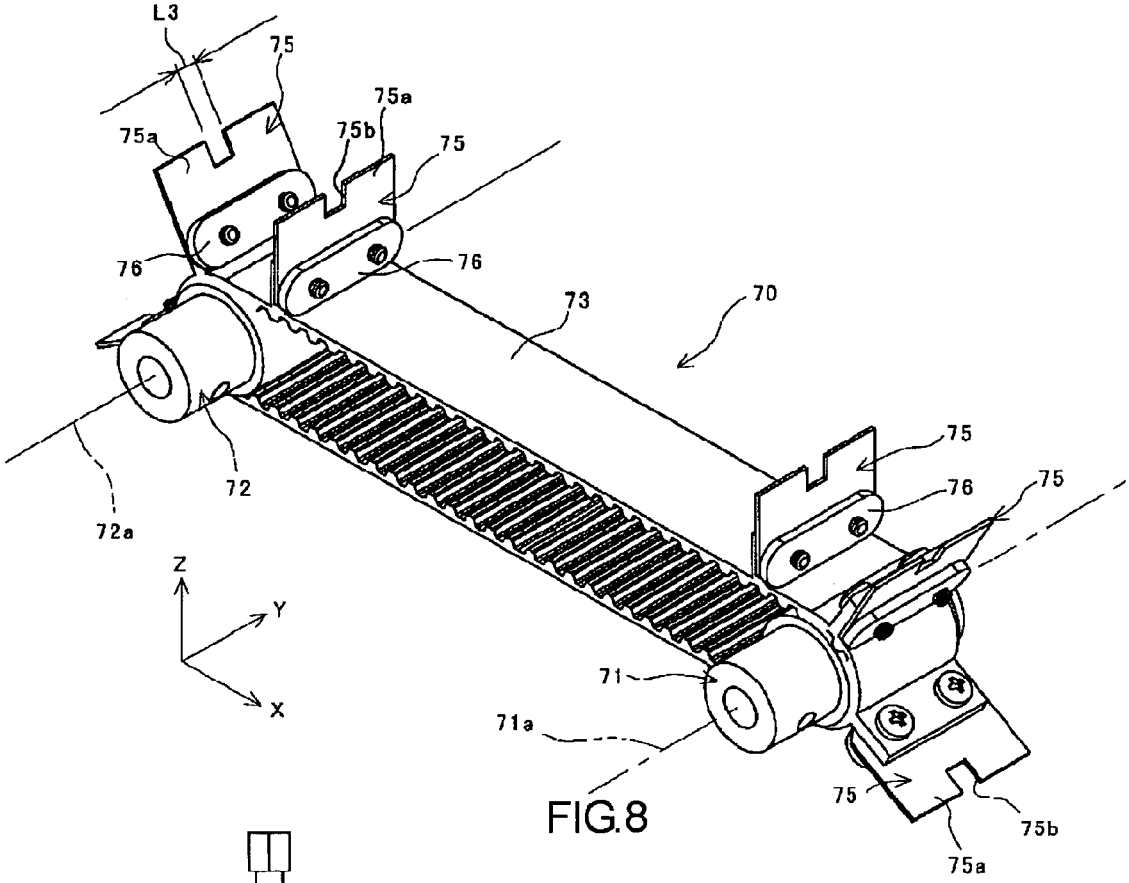
[FIG. 8] It is a perspective view illustrating the structure of a wiper blade unit according to the embodiment of the present invention.

As illustrated in FIGS. 5, 6 and 8, the wiper blade unit 70 includes ad rive roller 71, a dependent drive roller 72, a rubber-made endless belt 73 which is rolled up to the outer circumferences of the drive roller 71 and the dependent drive roller 72, a motor 74 for rotary driving the drive roller 71 and a plurality of scrapers (wiper blades) 75, which are so arranged on the endless belt 73 at predetermined intervals as to face outward. The drive roller 71 and the dependent drive roller 72 are arranged in the X-direction with shafts 71*a*, 72*a*, rotatably supported by the backing plate 52 and a front plate 53, be in the Y-direction. The plurality of scrapers 75 are tabular members made from approximately rectangular rubbers, one edges thereof are fixed to the endless belt 73 via fixtures 76, and they are arranged at predetermined intervals one another. Each of the plurality of scrapers 75 is fixed to the endless belt 73 in a perpendicular manner. When a force is supplied to the drive roller 71 from the motor 74, the drive roller 71 rotates around the shaft 71*a*, and thus the endless belt 73 rolled up the drive roller 71 starts moving, and the dependent drive roller 71 starts driving and rotating.

As illustrated in FIG. 8, among four edges of the scraper 75, the center of an edge 75*a*, farthest from the endless belt 73, is provided with a recess portion 75*b* which concaves toward the endless belt 73 with a predetermined width L3. In a halfway in which the printhead 31 moves to the head maintenance apparatus 42 along the carrier guide 33 for maintenance, and moves to the above of the recording medium feeder 20 after the maintenance for printing, the nozzle surface 34*a* moves toward the predetermined direction while rubbed by the plurality of moving edges 75*a* in a slide manner or pressed against them. The recess portion 75*b* is so arranged as to be placed at the path through which the nozzle 34*b* passes when the nozzle surface 34*a* is rubbed by the edge 75*a* in a slide manner (refer to FIG. 11). L3 is set as larger than the nozzle 34*b* by a predetermined magnitude. Accordingly, when the nozzle surface 34*a* moves while rubbed by the edge 75*a* in a slide manner, the edge 75*a* does not contact the lined nozzles 34*b* and an area with a predetermined width from that line. Therefore, it is possible to prevent that a contaminant is mixed into the nozzle 34*b* and the nozzle 34*b* is scratched, by allowing the edge 75*a* to pressure-contact it, and excessive ink on a portion, away from the nozzle 34*b*, of the nozzle surface 34*a* can be absorbed.

As explained above, the cleaner 50 is provided with the roller wiper unit 60 and the wiper blade unit 70, whereby excessive ink and a contaminant on the nozzle surface 34*a* can be absorbed by the roller member 61 and wiped by the scraper 75, and the nozzle surface 34*a* can be in a clean condition. As the roller wiper unit 60 is arranged closer to the recording medium feeder 20 than the wiper blade unit 70, even if excessive ink and a contaminant remain on the nozzle surface 34*a* after the maintenance at the head maintenance apparatus 42 and the scraping of excessive ink and a contaminant at the wiper blade unit 70, the roller member 61 can absorb them. Therefore, the print head 31 can be sent to the recording medium feeder 20 with the nozzle surface 34*a* cleaned, and a high print quality can be realize.

In the inkjet printer 10 structured thus way, when a printing start signal is transmitted to the print head 31 from a control circuit (not illustrated), the print head carrier 32 moves toward the X-direction along the carrier guide 33 and stops at a predetermined print position. A detection of the position of the print head carrier 32 is carried out by a well-known optical detection apparatus (not illustrated).

Next, a printing is carried out for the recording medium M, moved the below of the print head 31 by the recording medium feeder 20, by ink discharged from the print head 31.

Figure 9:
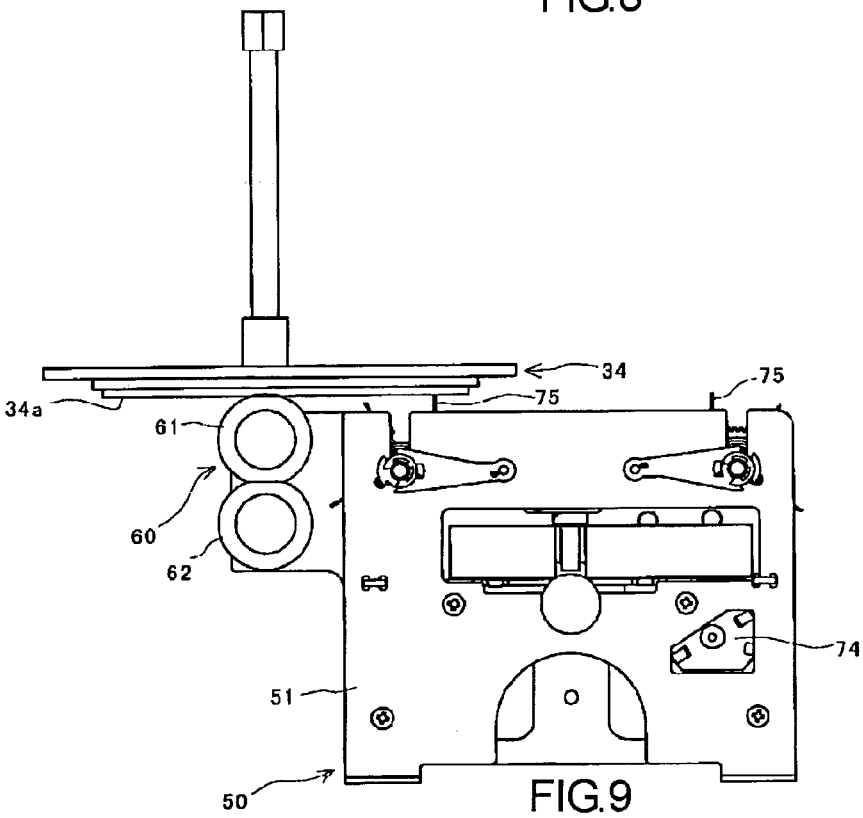
[FIG. 9] It is a diagram illustrating a condition that the nozzle surface according to the embodiment of the present invention is cleaned by the roller wiper unit and the wiper blade unit.
Figure 10:
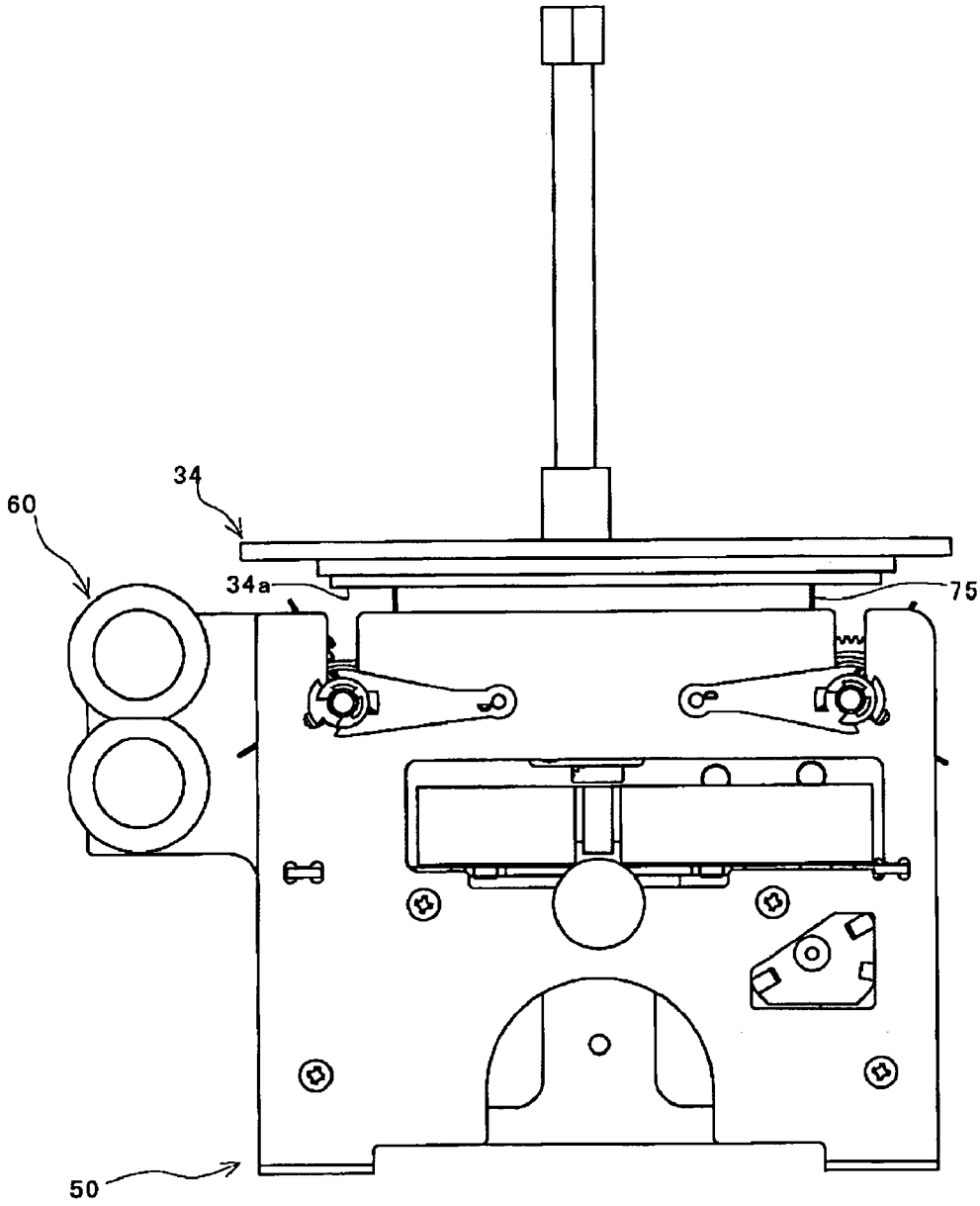
[FIG. 10] It is a diagram illustrating a condition that the nozzle surface according to the embodiment of the present invention is cleaned by the wiper blade unit.
Figure 11:
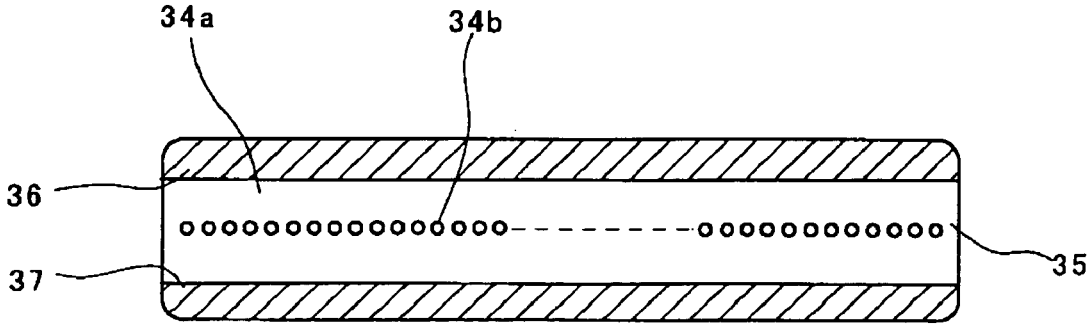
[FIG. 11] It is a top plan view illustrating an area with diagonal lines, in the nozzle surface according to the embodiment of the present invention, rubbed in a slide manner or pressure-contacted by the roller wiper unit or the wiper blade unit.

When the print quality is poor and the maintenance is required for the print head 31, the user allows the print head 32, holding the print head 31, to move toward the X-direction along the carrier guide 33 by carrying out a predetermined operation, and the maintenance such as the vacuuming of a contaminant on the nozzle surface 34*a* and the refilling of ink is carried out at the head maintenance apparatus 42. After the maintenance is finished and the printing is to restart the pint head carrier 32 is returned to the above of the recording medium feeder 20 again. When the print head carrier 32 is moved to the head maintenance apparatus 42 from the above of the recording medium feeder 20 this way, as illustrated in FIGS. 9 and 10, the nozzle surface 34*a* first pressure-contacts the roller member 61 (FIG. 9), and then rubbed by the scraper 75 in a slide manner (FIG. 10). When the print head carrier 32 is moved to the recording medium feeder 20 from the maintenance apparatus 42, it is first rubbed by the scraper 75 in a slide manner and then pressure-contacted with the roller member 61.

As the spacer 61*d* is placed between the first ink absorber 61*b*1 and the second ink absorber 61*b*2, when the ink absorber 61*b* are pressure-contacted with the nozzle surface 34*a*, the first ink absorber 61*b*1 and the second ink absorber 61*b*2 contact the nozzle surface 34*a* at outer areas 36, 37 of a nozzle-neighborhood area 35 (FIG. 11) including the nozzles 34*b* and having a predetermined width, but the ink absorber 61*b* does not contact the nozzle-neighborhood area 35. As the recess portion 75*b* is placed at the center of the edge 75*a*, when the scraper 75 is pressure-contacted with the nozzle surface 34*a*, the edge 75*a* contacts the nozzle surface 34*a* at the outer areas 36, 37 of the nozzle-neighborhood area 35 (FIG. 11) including the nozzles 34*b* and having the predetermined width, but the edge 75*a* does not contact the nozzle-neighborhood area 35. Accordingly, excessive ink on the outer areas 36, 37, away from the nozzle 34*b* at predetermined distances, can be scraped by the scraper 75 or absorbed by the ink absorber 61*b*, and a contaminant on the outer areas 36, 37 can be scraped by the scraper 75. In contrast, ink on the nozzle-neighborhood area 35 is pulled back to the inside of the nozzle 34*b* by the water-repellent finish applied to the nozzle surface 34*a* and the interfacial force of ink, or it flows into the outer regions 36, 37, scraped by the scraper 75 or absorbed by the ink absorber 61*b*.

The present invention is explained with reference to the aforementioned embodiment, but the present invention is not limited to the aforementioned embodiment and can be improved or modified for the purpose of the improvement or within the scope of the present invention. For instance, in the aforementioned embodiment, an example that the spacers 61*d*, 62*d* are fixed to, in bonded manners, or integrally formed with the shafts 61*a*, 62*a*, but the spacers 61*d*, 62*d* may be detachably attached to the shafts 61*a*, 62*a* by, for instance, screwing. For instance, the spacers 61*d*, 62*d* may be formed in shapes like screw nuts, and the shafts 61*a*, 62*a* may be formed with threads. The spacers 61*d*, 62*d* are detachable from the shafts 61*a*, 62*a* thus way, whereby the replacements of the second ink absorber 61*b*2, 62*b*2, which position at the backs of the spacers 61*d*, 62*d* in viewing from the cylindrical members 61*c* 62*c* sides, become easy.

Threads of the shafts 61*a*, 62*a* may be formed on predetermined regions which include adjustment regions for the attachment positions of the spacers 61*d*, 62*d*. When the attachment position of the spacer 61*d* is adjustable, the spacer 61*d* is placed so that it can precisely position on the path through which the nozzle 34*d* passes.

The cylindrical members 61*c*, 62*c* may be detachably attached to the shafts 61*a*, 62*a* in screwing manners. For instance, the cylindrical members 61*c*, 62*c* may be formed in shapes like screw nuts, and the shafts 61*a*, 62*a* may be formed with threads. When the cylindrical members 61*c*, 62*c* are detachable, the replacements of the ink absorbers 61*b*, 62*b* become easy.

The present invention is based on Japanese Patent Application No. 2003-356125 filed on Oct. 16, 2003. The specification, claims and drawings of the Japanese Application are hereby entirely incorporated in the present specification by reference.

INDUSTRIAL APPLICABILITY

The present invention can also be adapted to an inkjet printer which has a nozzle surface with a minute nozzle diameter.

The invention claimed is:

1. An inkjet printer comprising a recording medium feeder (20) which feeds a recording medium (M), a printer (30) which carries out a printing for the fed recording medium (M) by ink discharged from a nozzle surface (34*a*) formed on a print head (31), and a cleaner (50) which cleans said nozzle surface (34*a*), wherein said cleaner (50) includes a wiper blade unit (70) which wipes said nozzle surface (34*a*) with a plurality of wiper blades (75), and a roller wiper unit (60) which absorbs ink on said nozzle surface (34*a*) by roller members (61, 62) with ink absorbers (61*b*, 62*b*), wherein said roller member (61) is formed with a gap on an area of said roller member through which a nozzle (34*b*) passes upon contacting said nozzle surface (34*a*).

2. The inkjet printer according to claim 1, wherein said print head (31) is movable along a carrier guide (33) which elongates linearly, and said recording medium feeder (20) and said cleaner (50) are arranged side by side with each other along a movement direction of said print head (31).

3. The inkjet printer according to claim 2, wherein said roller wiper unit (60) is placed at a side closer to said recording medium feeder (20) than said wiper blade unit (70).

4. The inkjet printer according to claim 1, wherein said roller wiper unit (60) includes a plurality of roller members (61, 62), and said plurality of roller members (61, 62) are placed in such a manner as to allow outer circumferences thereof to be pressure-contacted with one another.

5. The inkjet printer according to claim 4, wherein said roller wiper unit (60) includes a first roller member (61) which is so placed as to be able to contact said nozzle surface (34*a*), and a second roller member (62) which placed at a position contacting said first roller member (61) but not contacting said nozzle surface (23*a*).

6. The inkjet printer according to claim 5, wherein said ink absorbers (61*b*, 62*b*) included in said first roller member (61) and said second roller member (62) contain porous materials, and said porous material contained in said ink absorber (61) of said first roller member (61) is coarser than said porous material contained in said ink absorber (62*b*) of said second roller member (62).

7. The inkjet printer according to claim 1, wherein said ink absorbers (61*b*, 62*b*) contain porous materials.

8. The inkjet printer according to claim 1, wherein said gap is formed by dividing said roller member (61) along the axial direction thereof, and placing a spacer (61*d*) between divided roller members (61*b*1, 61*b*2).

9. The inkjet printer according to claim 8, wherein said spacer (61*d*) is detachably placed on said roller member (61).

10. The inkjet printer according to claim 1, wherein said roller member (61) can be driven as said roller member contacts said nozzle surface (34*a*) which moves.

11. The inkjet printer according to claim 1, wherein said ink absorbers (61*b*, 62*b*) are replaceable.

12. The inkjet printer according to claim 1, wherein said wiper blade (75) is so fixed on an endless belt as to face outward, and formed with a recess portion (75*b*) on the area of said wiper blade through which a nozzle (34*b*) passes upon wiping said nozzle surface (34*a*).

13. An inkjet printer comprising a recording medium feeder (20) which feeds a recording medium (M), a printer (30) which carries out a printing for the fed recording medium (M) by ink discharged from a nozzle surface (34*a*) formed on a print head (31), and a cleaner (50) which cleans said nozzle surface (34*a*), wherein said cleaner (50) includes a wiper blade unit (70) which wipes said nozzle surface (34*a*) with a plurality of wiper blades (75), and a roller wiper unit (60) which absorbs ink on said nozzle surface (34*a*) by roller members (61, 62) with ink absorbers (61*b*, 62*b*), wherein said wiper blade (75) is so fixed on an endless belt as to face outward, and formed with a recess portion (75*b*) on the area of said wiper blade through which a nozzle (34*b*) passes upon wiping said nozzle surface (34*a*).

* * * * *